US010465515B2

(12) United States Patent
Pastorino et al.

(10) Patent No.: US 10,465,515 B2
(45) Date of Patent: Nov. 5, 2019

(54) GROUTABLE ROCK ANCHOR ASSEMBLY

(71) Applicant: NCM INNOVATIONS (PTY) LTD., Johannesburg (ZA)

(72) Inventors: Paolo Ettore Pastorino, Johannesburg (ZA); Adrian Berghorst, Johannesburg (ZA)

(73) Assignee: NCM INNOVATIONS (PTY) LTD., Johannesburg (ZA)

( * ) Notice: Subject to any disclaimer, the term of this patent is extended or adjusted under 35 U.S.C. 154(b) by 0 days.

(21) Appl. No.: 15/937,744

(22) Filed: Mar. 27, 2018

(65) Prior Publication Data

US 2019/0100998 A1 Apr. 4, 2019

Related U.S. Application Data

(63) Continuation-in-part of application No. 15/578,001, filed as application No. PCT/ZA2016/000017 on Jun. 23, 2016, now Pat. No. 10,344,593.

(30) Foreign Application Priority Data

Jun. 23, 2015 (ZA) ..... 2015/04498

(51) Int. Cl.
*E21D 20/02* (2006.01)
*E21D 21/02* (2006.01)
*E21D 21/00* (2006.01)

(52) U.S. Cl.
CPC ..... *E21D 21/0066* (2016.01); *E21D 20/028* (2013.01); *E21D 21/006* (2016.01);
(Continued)

(58) Field of Classification Search
CPC ... E21D 20/02; E21D 20/028; E21D 21/0033; E21D 21/006
See application file for complete search history.

(56) References Cited

U.S. PATENT DOCUMENTS 4,158,519 A * 6/1979 Gamlin ..... E21D 20/02
405/259.5
4,334,805 A * 6/1982 Morgan ..... E21D 21/0026
405/259.4
(Continued)

FOREIGN PATENT DOCUMENTS

CA 2490111 A1 * 12/2003 ..... E21D 20/02
CA 2494781 A1 * 2/2004 ..... E21D 20/02
(Continued)

OTHER PUBLICATIONS

International Search Report, dated Jul. 7, 2017, from corresponding International Application No. PCT/ZA2016/000017.

*Primary Examiner* — Frederick L Lagman
(74) *Attorney, Agent, or Firm* — Young & Thompson

(57) ABSTRACT

A rock anchor assembly includes a rock anchor with a flexible element and first/second cylindrical connector elements engaged to proximal and distal ends of the element, a flexible tubular sleeve longitudinally extending between first and second ends, on the rock anchor so end parts of the rock anchor project from sleeve ends; a load bearing barrel centrally bored engaging the first connector element between the first end of the sleeve and a proximal end of the rock anchor, the barrel engaging the first end of the sleeve in sealing contact, the barrel having a grout conduit between the barrel exterior and the bore, the conduit defining part of a grout passage interconnecting the barrel exterior and sleeve interior, when the barrel engages the sleeve; a seal preventing grout outflow but accommodating grout inflow; a tensioner engaging the first tubular connector element, and a mechanical anchor engaging the second tubular connector.

13 Claims, 8 Drawing Sheets

(52) U.S. Cl.
CPC ..... *E21D 21/008* (2013.01); *E21D 21/0033* (2013.01); *E21D 21/0046* (2013.01); *E21D 21/0006* (2013.01)

(56) References Cited

U.S. PATENT DOCUMENTS

| | | | | | |
|---|---|---|---|---|---|
| 4,697,960 | A * | 10/1987 | Pelto | E21D 20/023 | 366/10 |
| 5,375,947 | A * | 12/1994 | Gouws | E21D 20/028 | 405/259.5 |
| 5,378,087 | A * | 1/1995 | Locotos | E21D 11/006 | 405/259.5 |
| 5,458,442 | A * | 10/1995 | Ashmore | E21D 21/0026 | 405/259.1 |
| 5,636,945 | A * | 6/1997 | Nes | E21D 21/0086 | 405/259.1 |
| 6,402,433 | B1 * | 6/2002 | Gillespie | E21D 21/0026 | 405/259.1 |
| 7,381,013 | B1 * | 6/2008 | Rataj | E21D 21/0033 | 405/259.3 |
| 8,251,617 | B2 * | 8/2012 | Leppanen | E21D 21/008 | 405/302.2 |
| 8,714,883 | B2 * | 5/2014 | Rataj | E21D 21/0033 | 405/259.3 |
| 9,470,088 | B2 * | 10/2016 | Ahola | E21D 20/028 | |
| 2001/0038779 | A1 * | 11/2001 | Lausch | E21D 21/0026 | 411/250 |
| 2005/0158127 | A1 * | 7/2005 | Fergusson | E21D 21/0026 | 405/259.5 |
| 2006/0093438 | A1 * | 5/2006 | Fergusson | E21D 20/02 | 405/259.3 |
| 2008/0247828 | A1 * | 10/2008 | Craig | E21D 21/0046 | 405/259.1 |
| 2011/0168398 | A1 * | 7/2011 | Gray | E21B 21/10 | 166/325 |
| 2011/0217126 | A1 * | 9/2011 | Oldsen | E21D 20/028 | 405/259.4 |
| 2012/0034035 | A1 * | 2/2012 | Sligar | E21D 21/0026 | 405/259.1 |
| 2012/0163924 | A1 * | 6/2012 | Rataj | E21D 21/0033 | 405/259.3 |
| 2012/0177448 | A1 * | 7/2012 | Steyn | E21D 20/028 | 405/259.5 |
| 2014/0037388 | A1 * | 2/2014 | Ahola | E21D 20/02 | 405/259.3 |
| 2014/0105690 | A1 * | 4/2014 | Tadolini | E21D 21/008 | 405/259.1 |

FOREIGN PATENT DOCUMENTS

| | | | | |
|---|---|---|---|---|
| CA | 2763338 | A1 * | 7/2012 | F16B 13/066 |
| CA | 2893814 | A1 * | 6/2014 | E21D 20/028 |
| WO | WO-9218752 | A1 * | 10/1992 | E02D 5/76 |
| WO | 2004013463 | A1 | 2/2004 | |
| WO | 2010104460 | A1 | 9/2010 | |
| WO | 2012113976 | A1 | 8/2012 | |
| WO | 2014091074 | A1 | 6/2014 | |

* cited by examiner

GROUTABLE ROCK ANCHOR ASSEMBLY

FIELD OF THE INVENTION

The invention relates to an apparatus for grouting a rock anchor in a rock hole.

BACKGROUND OF INVENTION

This invention relates to an improvement or modification to, or development on, a rock bolt assembly as described in the specification to a patent application PCT/ZA2016/000017 which is hereinafter referred to as the parent patent and which specification is herein incorporated by reference.

The rock bolt assembly provides a solution to grouting a rock anchor within a rock hole which, typically, is a difficult and messy affair.

However, the rock bolt assembly described in the parent specification is rigid, making it difficult to install in a narrow slope environment.

The invention at least partially solves the aforementioned problems.

SUMMARY OF INVENTION

A rock anchor assembly is provided by the invention which includes a rock anchor comprising a flexible element and a first and a second cylindrical connector element engaged to a proximal end portion and a distal end portion respectively of the element, a tubular sleeve, made at least of a flexible material that longitudinally extends between a first end and a second end, on the rock anchor such that end parts of the rock anchor project from the first and second ends respectively of the sleeve; a load bearing barrel which is centrally bored to engage the first connector element between the first end of the sleeve and a proximal end of the rock anchor, which barrel is adapted to engage with the first end of the sleeve in sealing contact, and which barrel has at least one grout conduit between an exterior surface of the barrel and the bore, which at least one conduit defines a part of a grout passage which communicates the exterior surface of the barrel with an interior of the sleeve, when the barrel is engaged with the sleeve; a seal which seals the grout passage to grout outflow but accommodates inflow of grout from a source; a tensioning means engaged with the first tubular connector element between the proximal end of the rock anchor and the barrel, and a mechanical anchor engaged with the second tubular connector.

The flexible element may be a length of cable manufactured from steel or a composite material.

The connector elements may be made of a steel or composite material.

Each steel connector element may be swaged onto the respective proximal and distal end portions of the cable.

The sleeve may have a flared end section which opens onto the first end and an anchor housing section which opens onto the second end.

The load bearing barrel may be comprised of a solid body of a suitable metal material which has a domed or conical forward end and an opposed back end.

The barrel may have a plurality of grout conduits. The plurality of grout passages may be evenly radially spaced about the body.

The tensioning means maybe a nut threaded onto complementary threads formed on the first tubular connector.

The assembly may include a tubular spacer on the rock anchor between the first end of the sleeve and the forward end of the barrel or between the back end of the barrel and the tensioning means.

The tubular spacer may be made of a suitable plastics material which deforms or breaks when a compressive force is applied to it to collapse or break away from the rock anchor, allowing the rock anchor to move longitudinally relatively to the sleeve between a first position and a second position.

The mechanical anchor may be at least partially received within the anchor housing section of the sleeve in an unexpanded configuration when the rock anchor is in the first position.

The mechanical anchor may move from the sleeve into an expanded configuration when the rock anchor is in the second position.

The assembly may include a grout delivery coupling member which includes a body with a member first end and a member second end and a passage between the ends, a circular distributing channel in a wall of the passage and a grout inlet port in a side of the member which communicates an exterior of the member with the channel, wherein the passage is adapted to at least partially receive the barrel from the member first end and to engage with the barrel in a position in which the at least one grout conduit of the barrel sealingly docks with the channel.

The coupling member may engage with the barrel in a twist-lock manner.

The barrel, alternatively the coupling member, may have a plurality of bayonet type projections which engage with complementary slots or recesses on the coupling member, alternatively the barrel.

A grouting kit for grouting a rock anchor in a rock hole which includes a load bearing barrel which is centrally bored to engage with the rock anchor and which has at least one grout conduit between an exterior surface of the barrel and the bore and a seal which seals the grout conduit, and a grout delivery coupling member which includes a body with a first end and a second end and a passage between the ends, a circular distributing channel in a wall of the cylindrical passage and a grout inlet port in a side of the member which communicates an exterior of the member with the channel, wherein the passage is adapted to receive the barrel from the first end and to engage with the barrel in a position in which the at least one grout conduit sealingly docks with the channel.

The load bearing barrel may be comprised of a solid body of a suitable metal material which has a domed or conical forward end and an opposed back end.

The barrel may have a plurality of grout conduits. The plurality of grout passages may be evenly radially spaced about the body.

The coupling member may engage with the barrel in a twist-lock manner.

The barrel, alternatively the coupling member, may have a plurality of bayonet type projections which engage with complementary slots or recesses on the coupling member, alternatively the barrel.

The invention provides a method of anchoring a rock anchor assembly within a rock hole, the rock anchor assembly including a flexible outer sleeve which extends between a first end and a second end opening; a rock anchor which locates, at least partially, within the sleeve such that end parts of the rock anchor extend beyond the first end and the second end of the sleeve, the rock anchor comprising a flexible cable and a first and a second cylindrical connector element engaged to a proximal end portion and a distal end portion respectively of the cable; with the first cylindrical connector element carrying a mechanical anchor which is at least partly held within the sleeve in a closed position and the second cylindrical connector element being at least partly threaded; a faceplate located over the sleeve; a barrel on the threads of the second connector element and a fastener on the threads between the barrel and a proximal end of the rock anchor; the method including the steps of pre-spacing the barrel from the first end or the pre-spacing of the fastener from the barrel; inserting the rock anchor assembly into a predrilled rock hole, a distal end of the rock anchor leading, until the faceplate is sandwiched between rock wall and the sleeve or the barrel and pushing the anchor further into the rock hole to close the pre-spacing allowing the rock anchor to move relatively to the sleeve to drive the mechanical anchor from the first end of the sleeve and into a radially expansive open position in which the mechanical anchor resistively engages the walls of the rock hole.

The pre-spacing of the barrel from the first end of the sleeve or the pre-spacing of the fastener from the barrel may be achieved with a tubular spacer which locates on the cable anchor, between the first end of the sleeve and barrel or between the barrel and the fastener.

The tubular spacer may be made of a suitable plastics material which deforms or breaks when a force pushing the anchor further into the hole reaches a predetermined level.

To introduce a grout into the rock hole, the method may include the additional steps of engaging a coupling device to the barrel and pumping a grout material from a source through the coupling device and at least one channel provided in a sidewall of the barrel, into an annular space between the sleeve and the cable and, eventually, into an annular space between the sleeve and walls of the rock hole.

BRIEF DESCRIPTION OF THE DRAWINGS

The invention is described with reference to the following drawings in which.

DESCRIPTION OF PREFERRED EMBODIMENTS

Referring to FIGS. 1 to 4 of the accompanying drawings, a rock anchor assembly 10 is provided.

Figure 1:
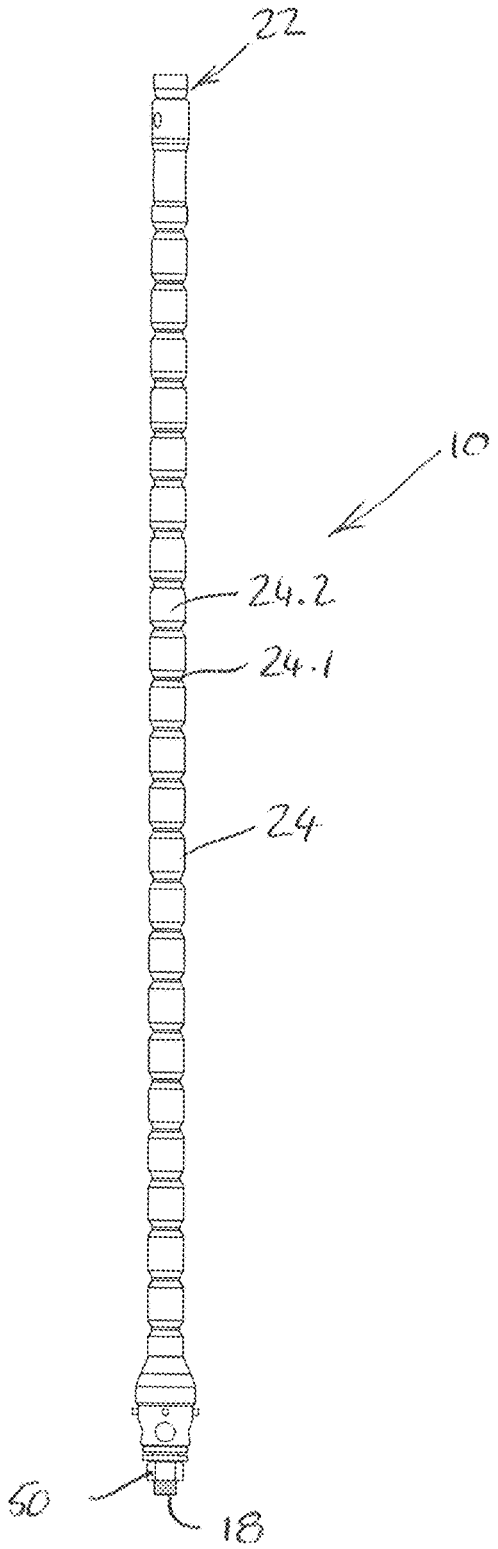
FIG. 1 illustrates a view in elevation of a rock anchor assembly in accordance with a first embodiment of the invention.
Figure 2B:
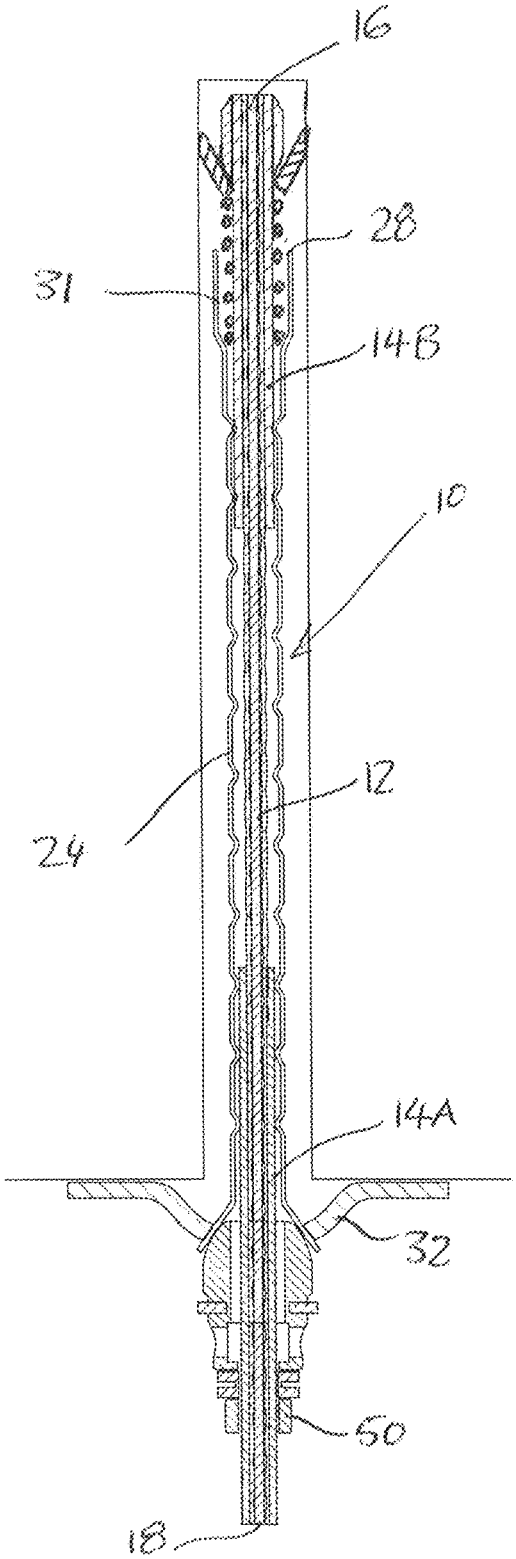
FIGS. 2A and 2B illustrate a longitudinal section through the rock anchor assembly of FIG. 1.
Figure 2A:
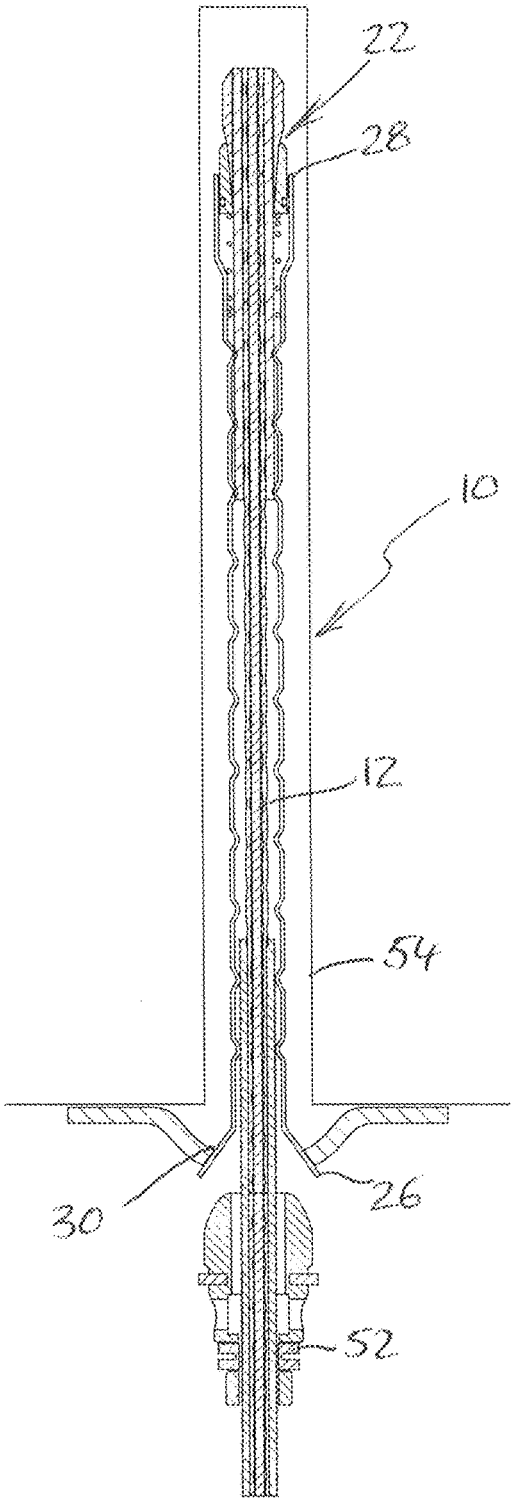

With reference to FIGS. 2A and 2B, the assembly includes a rock anchor which comprises a length of flexible high tensile cable 12, of a steel or composite material, which extends between a distal end 16 and a proximal end, 18. The anchor has a first and a second tubular metal connector element, respectively designated 14A and 14B, each of which is swaged onto a respective end section of the cable by employing a radial swaging method.

It is also anticipated within the scope of this invention that the connector elements 14 can be made of a composite material which is bonded to the cable by any suitable technique.

The first connector element 14A is, at least, partially externally threaded with a threaded section 20. A mechanical anchor 22 locates on the second connector element, towards the distal end 16 of the cable. The mechanical anchor is a standard expansion shell type anchor.

The assembly 10 includes an elongate tubular sleeve 24 made of a flexible material such as LDPE, HDPE or polypropylene. Although the material of the sleeve is inherently flexible, increased flexibility is introduced by forming the sleeve with a plurality of relatively flexible sections 24.1 interspersed with relatively inflexible sections 24.2. This provides a corrugated outer surface which aids in providing purchase to a grout column in use.

Referring to FIGS. 2A and 2B, the sleeve extends between a first end 26 and a second end 28. At one end, the sleeve flares into a flared end section 30 which opens on the first end 26. The sleeve also slightly flares at the opposed end, opening onto the second end 28. This slightly flared formation provides an anchor housing section 31. In one alternative, the flared end sections can be integrally formed with the remainder of the sleeve. In another, the sections can be separately made, from a metal material, and riveted to the sleeve.

The connector elements 14A and 14B of this embodiment are metal studs with a bore 60 that longitudinally extends only partially through each stud. The distal and proximal ends (16, 18) of the cable are inserted into the bore, in the manufacture of the rock anchor component, the proximal and distal end portions of the cable are fixed within the respective connector element by employing a radial swaging technique.

Figure 8:
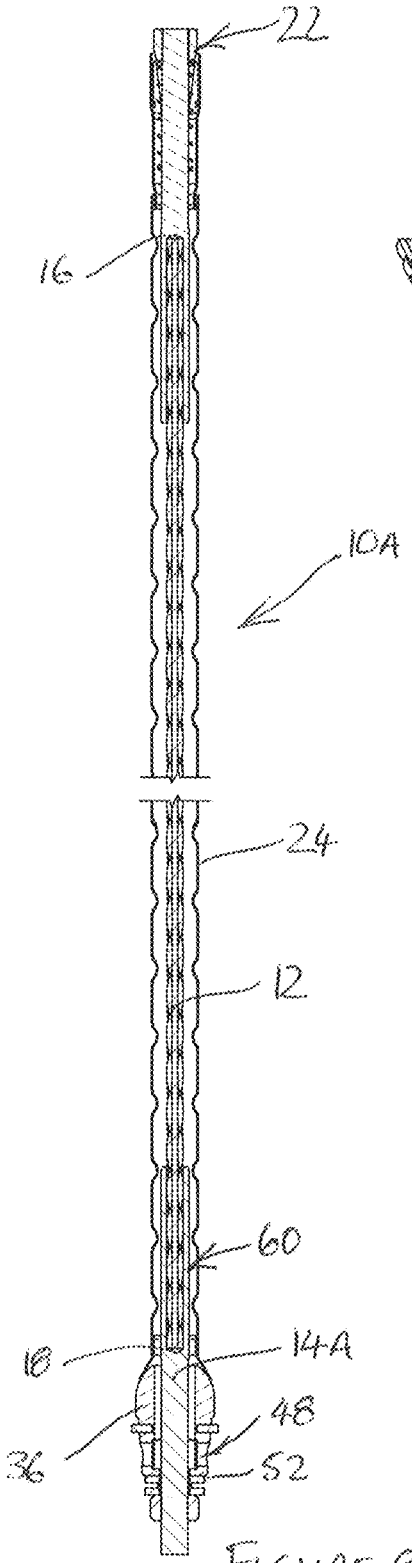
FIG. 8 illustrates a longitudinal section through a rock anchor assembly in accordance with a second embodiment of the invention.
Figure 9:
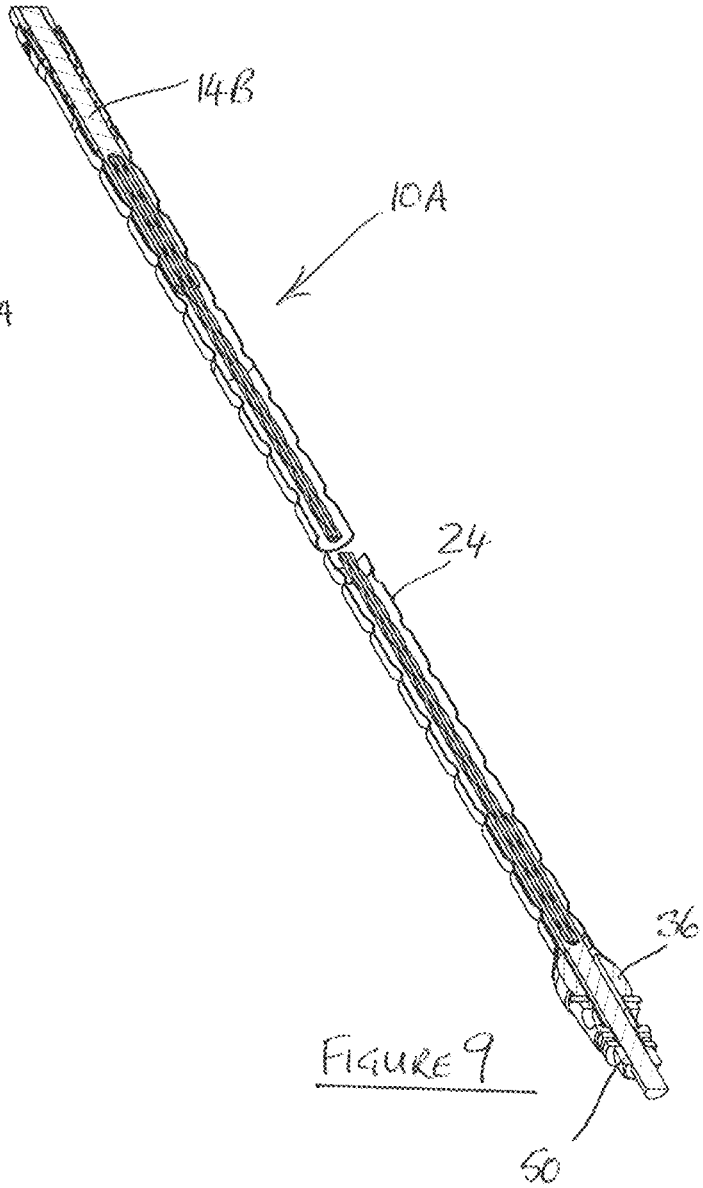
FIG. 9 isometrically illustrates, in longitudinal section, the rock anchor assembly of FIG. 8.

FIGS. 8 and 9 illustrate a second embodiment of the invention. In this embodiment, the rock anchor assembly 10A has a rock anchor component which comprises the cable 12 and a first and second connector element (14A and 14B). However, the essential difference between this embodiment and the earlier embodiment (10) is the connector elements are not tubular and the cable does not extend through the element from end to end as is illustrated in FIGS. 2A to 2D.

The sleeve is adapted to receive the cable anchor with a distal end and a proximal end part (16, 18) of the anchor extending beyond the first end and second ends (26, 28) respectively of the sleeve. The sleeve is held in position on the cable by frictional engagement with the anchor 22 which is at least partially received in the anchor housing section 31 of the sleeve as illustrated in FIG. 2A.

The assembly (10 and 10B) includes a faceplate 32 which as shown in FIGS. 2A and 2B, rests on an outer surface of the flared end section 30. The sleeve 24 is engaged with the faceplate by passage through a central aperture 34 (see FIG. 2C) of the plate.

Figure 5A:
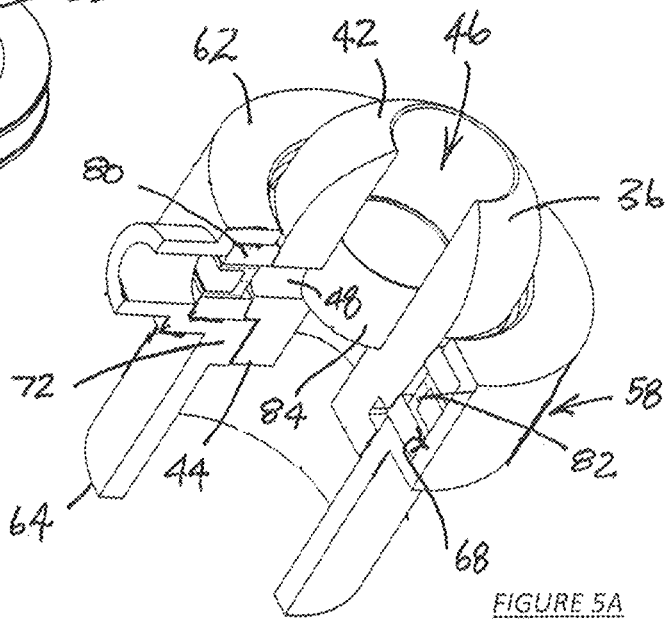
FIGS. 5A and 5B isometrically illustrate, in partial section, a first embodiment of a barrel and a coupling member assembly which attaches to the rock anchor assembly.
Figure 5B:
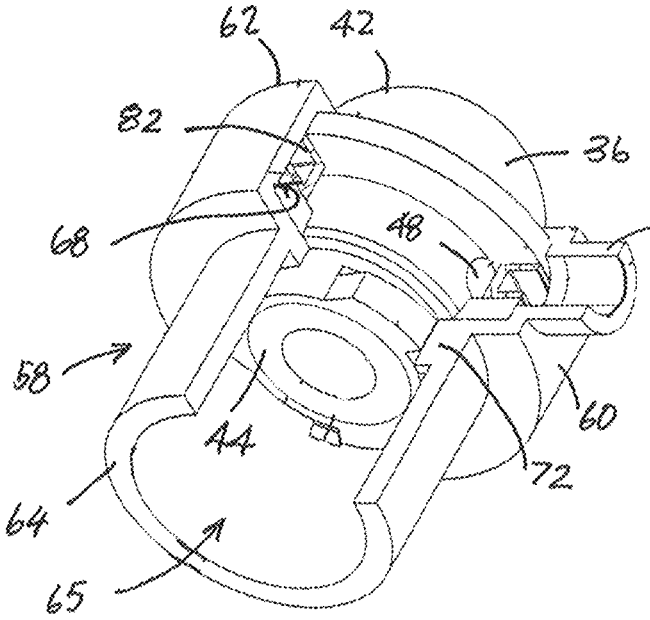

As best illustrated in FIGS. 5A and 5B, the assembly (10 and 10B) further includes a barrel 36 comprised of a solid barrel-shaped metal body 38. The body 38 has a domed end 42 and a trailing end 44 with a central bore 46 extending between the ends. In a sidewall of the barrel, a plurality of grout conduits 48 are formed (only one is illustrated in the Figures), uniformly radially spaced, communicating an exterior of the barrel with the bore 46.

Figure 4:
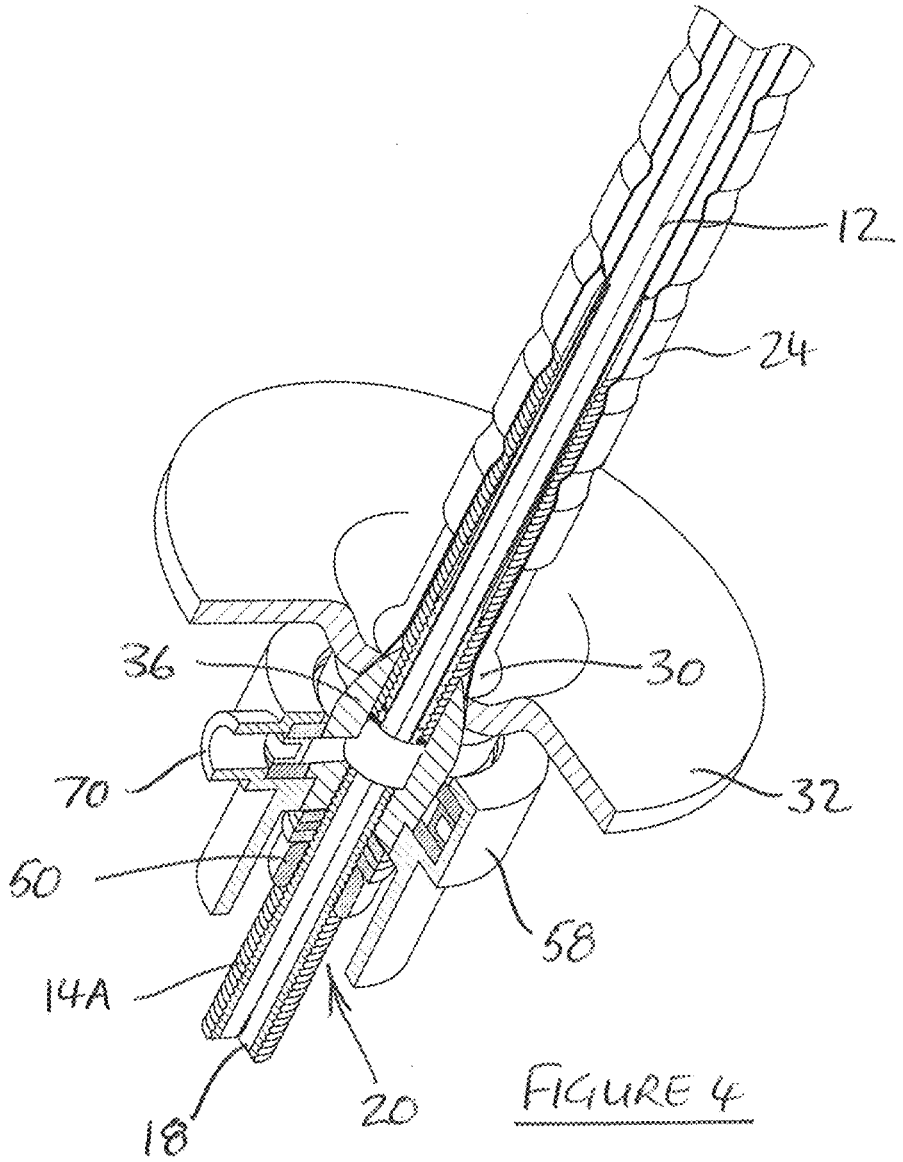
FIG. 4 isometrically illustrates the rock anchor assembly, partially pie-sectioned.

The rock anchor is passed through the barrel's central bore 46, from the cable's proximal end 18, to locate on the threaded section 20 of the first connector element 14A. This is best illustrated in FIG. 4. To hold the barrel 36 in position on the threaded section, initially spaced from the flared end section 30 of the sleeve 24, a nut 50 is threaded onto the threaded section 20 to eventually contact the trailing end 44 of the barrel's body. A load indicating washer 52 can be interposed between the nut 50 and the trailing end 44 to indicate when load on the barrel has reached a predetermined level.

Prior to grouting and with the rock anchor received in the sleeve 24 and the faceplate 32 and barrel 30 pre-attached as described, the rock assembly (10 and 10B) is inserted into a pre-drilled rock hole 54 with the distal end 16 of the cable leading. In this pre-configuration, the anchor housing section 31 of the sleeve at least partially covers the mechanical anchor 22, as illustrated in FIG. 2A, to retain the anchor in a closed unexpanded position.

When the faceplate 32 comes into contact with the hanging wall 56 the sleeve 24 is prevented from further passage into the rock hole by the flared end section 30 making contact with the faceplate. However, the cable 12 is capable of further movement, axially inwardly relatively to the sleeve, as illustrated in FIG. 2B. The cable is rigid enough to be pushed in the axial direction without buckling. This pushing movement forces the mechanical anchor 22 from the confines of the sleeve allowing the anchor to radially expand under spring action into frictional engagement with the surrounding walls of the rock hole 54. The mechanical anchor will thus secure the rock anchor assembly within the rock hole about the second tubular connector element 14B.

Upward movement of the rock bolt also will cause the domed end 40 of the barrel 36 to come into sealing contact with an inside of the flared end section 30. This is as illustrated in FIG. 2B. The nut 50 can now be tightened against the barrel to bring about load bearing contact of the barrel with the flared end section of the sleeve. The assembly 10 is now ready to be grouted.

Figure 2D:
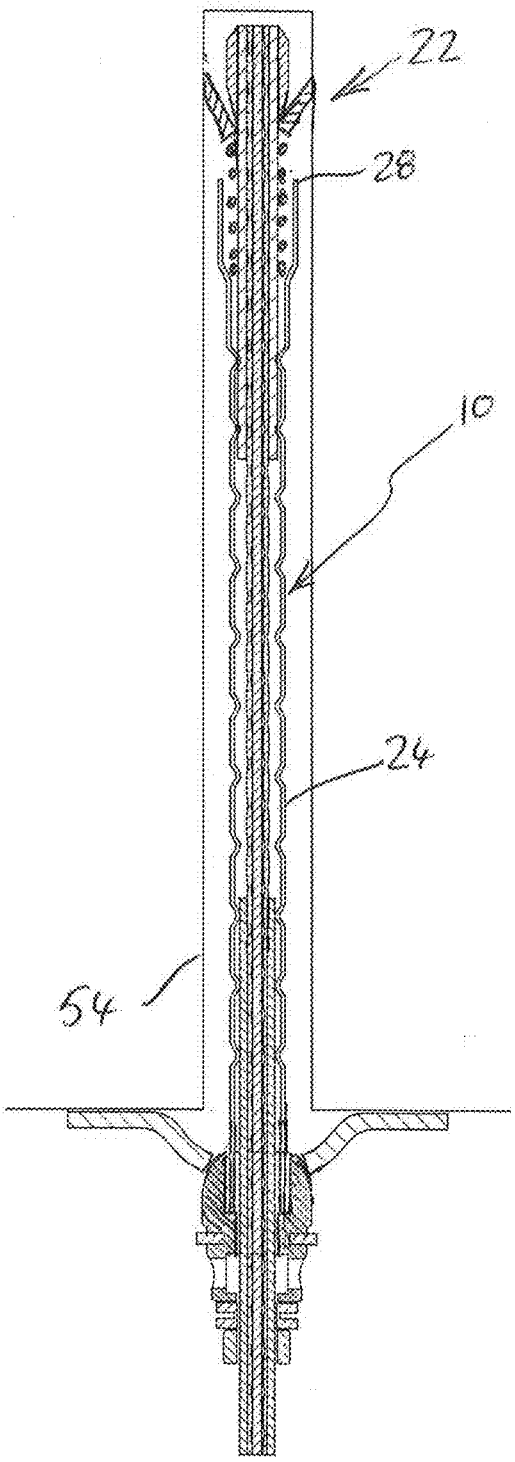
FIGS. 2C and 2D illustrate longitudinal sections through the rock anchor assembly, showing a different engagement of a sleeve and a barrel of the assembly.
Figure 2C:
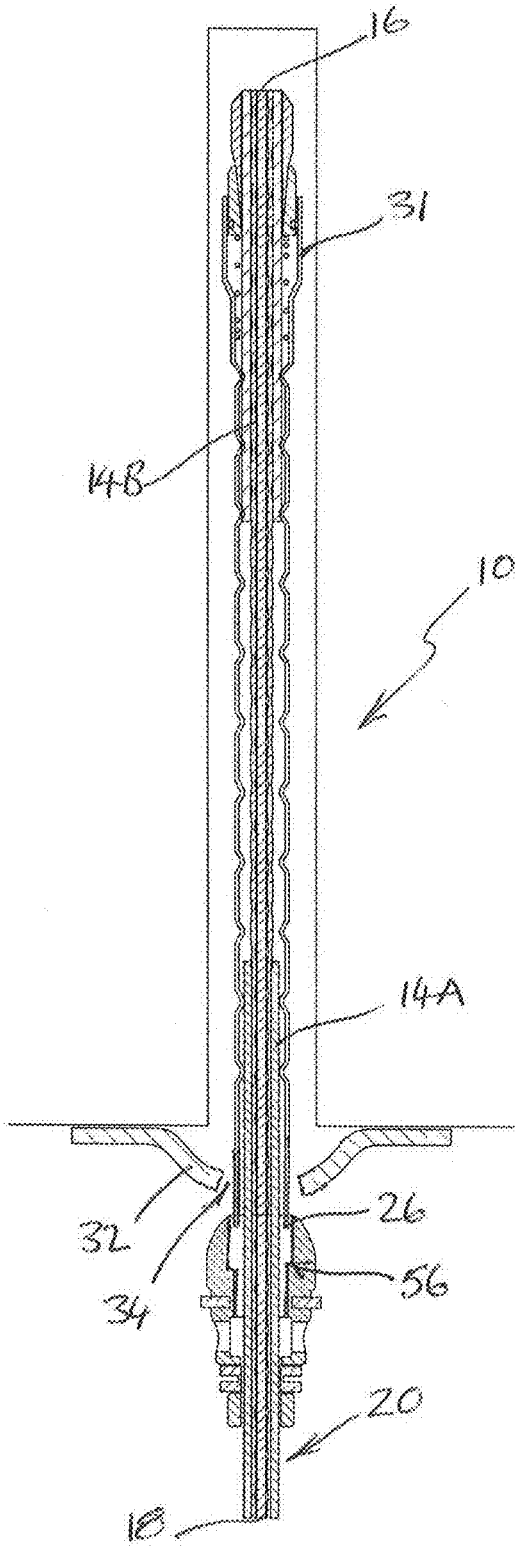
Figures 3A, 3B:
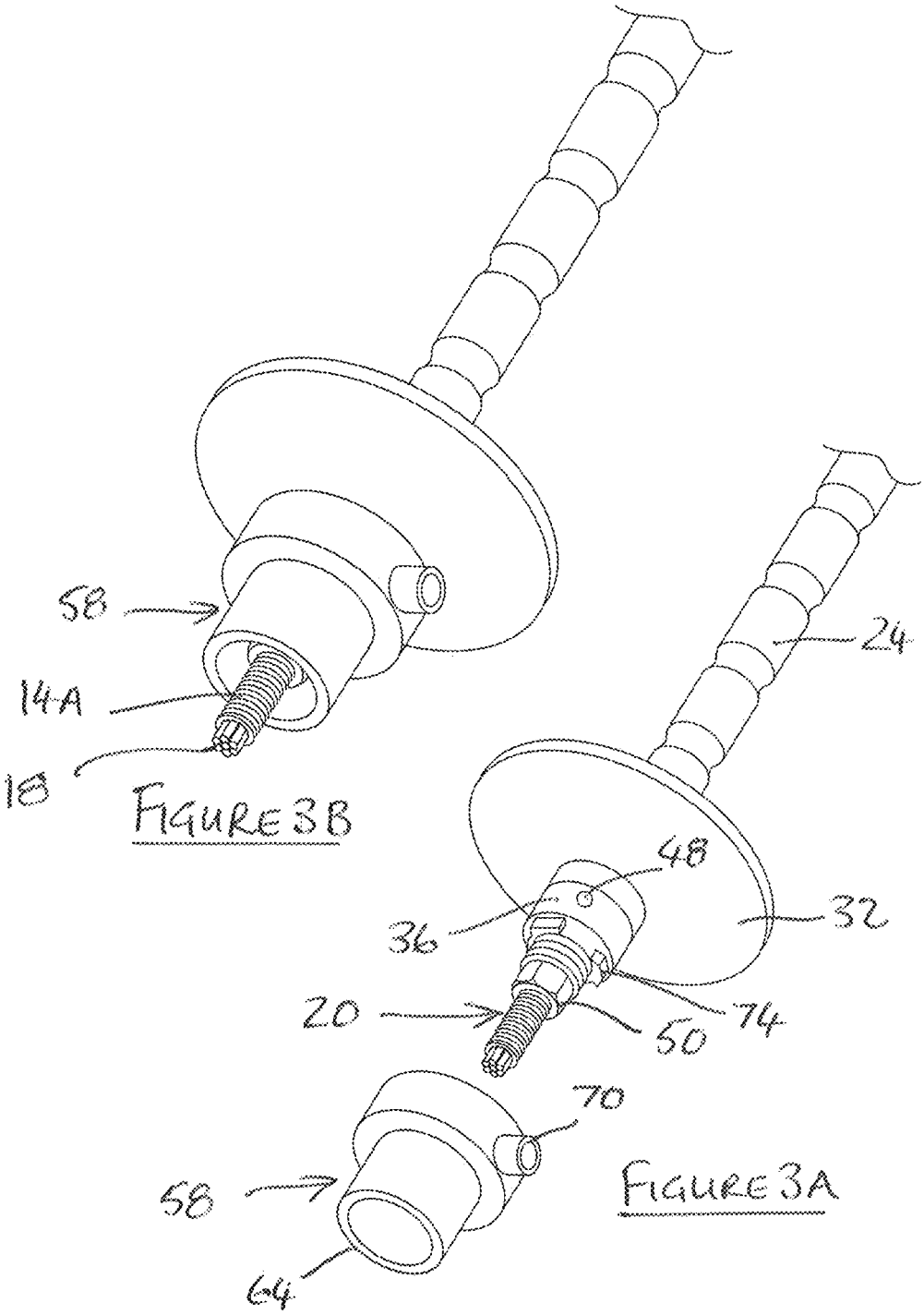
FIGS. 3A and 3B isometrically illustrate the assembly of FIGS. 2A and 2B.

An alternative to the flaring of the sleeve, to provide sealing engagement of the sleeve and the barrel, is illustrated in FIGS. 2C and 2D. In this variation the sleeve is without a flared end. The first end 26 of the sleeve inserts within the bore 46 of the barrel, sealingly abutting an annular ridge 56 on an inside surface of the bore of the barrel.

To enable grouting of the assembly 10, a coupling member 58 is provided. The coupling member 58 includes a body 60 which extends between a first end 62 and an opposed second end 64. The body defines a cylindrical passage 65 which extends between the ends.

In an inner wall of the cylindrical passage 65, a circular distributing channel 68 is formed. The channel is disposed towards the first end 62. A hole penetrates the channel which leads into a corresponding side projecting inlet port 70. The inlet port is adapted to attach to a grout delivery from a hose (not shown). The port thus communicates with the bore 46 via the hole, the channel and the conduit 48.

Below the channel 68, towards the second end 64, the cylindrical passage is formed with a locking formation 72 which receives complementary bayonet formations 74 (see FIG. 3A) in twist lock engagement as more fully described below. The bayonet formation laterally extends from an outer surface of the barrel 36 towards the trailing end 44 of said barrel.

Figure 6:
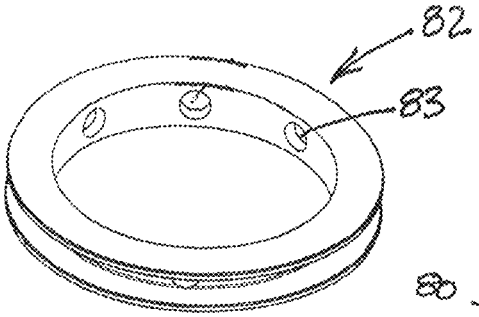
FIG. 6 is an isometric illustration of a circular spacing ring which is included in the coupling member illustrated in FIGS. 5A and 5B.

On a floor and a roof surface (respectively designated 76 and 78 on FIG. 4) of the channel 68, a respective circular sealing formation 80 is provided, held apart by a spacing ring 82 (see FIG. 6). Apertures 83 of the ring allow the passage of grout as will be explained more fully below.

The coupling member 58 is to be attached to the barrel 36 so that grout, from a source (not shown), can be delivered through the barrel and into the sleeve. Firstly, the grout delivery hose is pre-attached to the inlet port. Secondly, an elevating shaft (not shown) is connected, at one end, to the second end 64 of the coupling member by, for example, receiving the second end within a complimentary shaped recess in the end of the lance. Thereafter, the coupling member 58 is elevated on the shaft and presented to a barrel engaged end of the pre-installed rock anchor assembly 10, the first end 62 of the member leading.

The barrel 36 is then partially received into the cylindrical passage 65 from the first end 62 and engaged with the coupling member 58 within the passage. Engagement is achieved by twisting the coupling member relatively to the barrel to receive the bayonet formation 74 of the barrel within the locking formation 72.

Locked within the passage, the barrel is positioned such that each of the grout conduits 48 is in planar alignment with the circular distribution channel 68. The opposed sealing formations 80 in the channel seal the docking engagement of the grout conduits with the distributing channel.

Grout can now be pumped through the grout delivery hose for delivery to the inlet port 70, through the side hole 69 and into the grout distributing channel 68. In the channel, grout is circumferentially distributed about the barrel for entry into the central bore 46 through each of the plurality of grout conduits 48. Grout egress from points of contact of the barrel with the coupling member 58 is prevented by the sealing formations 80 which sandwich the channel.

Flowing from the grout conduits 48, the grout passes a band seal 84 which is caused to move away from an exit of each grout conduits to allow the grout to flow into an interior of the sleeve 24 via the bore 46. Within the sleeve, about the cable 12, the grout percolates upwardly until reaching the first end 24 of the sleeve, at which point the grout cascades downwardly into the annular space between the sleeve and the rock-hole walls.

Grout is prevented from flowing back into the grout conduits 48 by the band seal 84 which is forced back against the exits of the grout conduits.

Thus, with the grouting of the rock anchor assembly 10, the cable 12 is grouted within the sleeve 24 which, in turn, is grouted within the rock hole.

The barrel 36 and the coupling member do not need to have means to inter-engage. It is also anticipated that the coupling member can be held in place, over the barrel, by an external installation machine or tool.

Figure 7A:
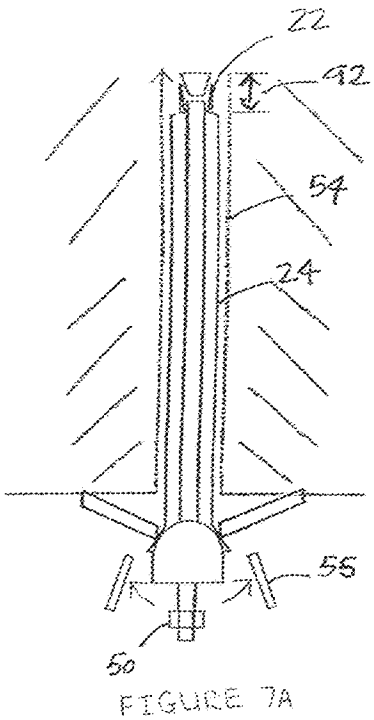
FIGS. 7A to 7C diagrammatically and sequentially illustrate the rock anchor assembly of either embodiment with a tubular spacer being inserted into a rock hole in a method of the invention.
Figure 7B:
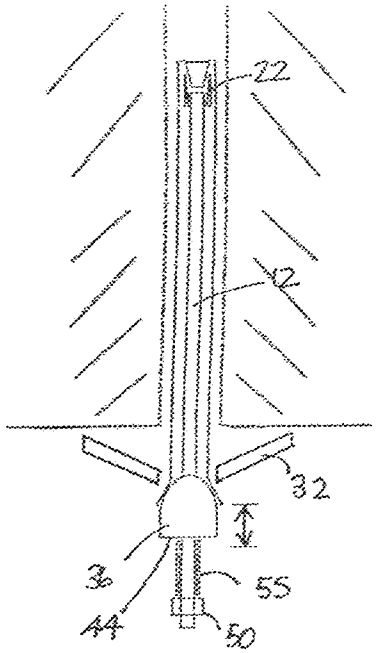
Figure 7C:
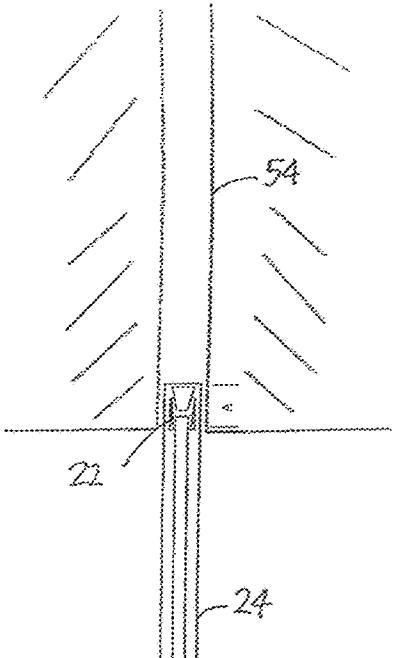

FIG. 7 illustrates use of the rock bolt assembly (10A and 10B) which has a tubular spacer 55 made of a suitable plastics material. The spacer 55 provides a suitable offset space (designated 92 on FIGS. 9A and 9C) equivalent to the distance of longitudinal travel (also designated 92 on FIG. 9C) that is required of the cable 12 relatively to the sleeve 24, once in the assembly is in the rock hole, to move the mechanical anchor 22 from the confines of the sleeve so that it can radially expand into frictional engagement with the rock hole walls.

Once installed, a further inwardly directed force on the rock bolt 14 by, for example, the installation machine (not shown) will be taken up by the sleeve 55 which will eventually collapse or break away at a pre-defined load point. This is illustrated in FIG. 8C.

With relative longitudinal movement of the cable 12 relatively to the sleeve 24 no longer prevented by the collapsed or moved spacer 55, the cable moves inwardly relatively to the sleeve and, in so doing, the nested mechanical anchor 22 is pushed from the confines of the sleeve. Unconfined, the mechanical anchor radially expands under spring biasing action.

The tubular spacer 55 is pre-installed to provide a complete unit of the assembly (10A and 10B) and is sandwiched, in this example, between the trailing end 44 of the barrel 36 and the nut 50.

The flexibility of the cable 12 and the sleeve 24 allow the assembly (10A and 10B) to be bent sufficiently to allow installation in a narrow stope environment, whilst maintaining all the benefits of the rock bolt assembly of the parent specification i.e. a means of efficient and clean introduction of a grout into the rock hole to grout the rock anchor, a means of mechanically anchoring the rock anchor into the hole before grouting and an improved static load carrying capacity.

The invention claimed is:

1. A rock anchor assembly which includes a rock anchor comprising a flexible element and a first and a second cylindrical connector element engaged to a proximal end portion and a distal end portion respectively of the element; a tubular sleeve, made at least of a flexible material that longitudinally extends between a first end and a second end, on the rock anchor such that end parts of the rock anchor project from the first and second ends respectively of the sleeve; a load bearing barrel which is centrally bored to engage the first connector element between the first end of the sleeve and a proximal end of the rock anchor, which barrel is adapted to engage with the first end of the sleeve in sealing contact, and which barrel has at least one grout conduit between an exterior surface of the barrel and the bore, which at least one conduit defines a part of a grout passage which communicates the exterior surface of the barrel with an interior of the sleeve, when the barrel is sealingly engaged with the sleeve; a seal which seals the grout passage to grout outflow but accommodates inflow of grout from a source; a tensioning means engaged with the first cylindrical connector element between the proximal end of the rock anchor and the barrel; and a mechanical anchor engaged with the second cylindrical connector element; wherein the assembly includes a tubular spacer on the rock anchor between the first end of the sleeve and the forward end of the barrel or between the back end of the barrel and the tensioning means; wherein the tubular spacer is made of a suitable plastics material which deforms or breaks when a compressive force is applied to it to collapse or break away from the rock anchor, allowing the rock anchor to move longitudinally relatively to the sleeve between a first position and a second position; wherein the sleeve has a flared end section which opens onto the first end and an anchor housing section which opens onto the second end; wherein the mechanical anchor is at least partially received within the anchor housing section of the sleeve in an unexpanded configuration when the rock anchor is in the first position; wherein the mechanical anchor moves from the anchor housing section of the sleeve into an expanded configuration when the rock anchor is in the second position.

2. A rock anchor assembly according to claim 1 wherein the flexible element is a length of cable manufactured from steel or a composite material.

3. A rock anchor assembly according to claim 2 wherein the connector elements are made of a steel or a composite material.

4. A rock anchor assembly according to claim 2 wherein the load bearing barrel is comprised of a solid body of a metal material which has a domed or conical forward end and an opposed back end.

5. A rock anchor assembly according to claim 1 wherein the connector elements are made of a steel or a composite material.

6. A rock anchor assembly according to claim 5 wherein the connector element is made of a steel material and the connector element is swaged onto the respective proximal and distal end portions of the cable.

7. A rock anchor assembly according to claim 6 wherein the load bearing barrel is comprised of a solid body of a metal material which has a domed or conical forward end and an opposed back end.

8. A rock anchor assembly according to claim 5 wherein the load bearing barrel is comprised of a solid body of a metal material which has a domed or conical forward end and an opposed back end.

9. A rock anchor assembly according to claim 1 wherein the load bearing barrel is comprised of a solid body of a metal material which has a domed or conical forward end and an opposed back end.

10. A rock anchor assembly according to claim 9 wherein the barrel has a plurality of grout conduits.

11. A rock anchor assembly according to claim 1 wherein the tensioning means is a nut which is threaded onto complementary threads formed on the first cylindrical connector element.

12. A method of anchoring a rock anchor assembly within a rock hole, the rock anchor assembly including a flexible outer sleeve which extends between a first end and a second end; a rock anchor which locates, at least partially within the sleeve, such that end parts of the rock anchor extend beyond the first end and the second end of the sleeve, the rock anchor comprising a flexible cable which extends between a proximal end and a distal end and a first and a second cylindrical connector element engaged to a proximal end and a distal end respectively of the flexible cable, with the first cylindrical connector element carrying a mechanical anchor which is at least partly held within the sleeve in a closed position and the second cylindrical connector element being at least partly threaded, a faceplate located over the sleeve, a barrel on the threads of the second connector element and a fastener on the threads between the barrel and a proximal end of the rock anchor, the method including the steps of pre-spacing the barrel from the first end or the fastener from the barrel, inserting the rock anchor assembly into a predrilled rock hole, a distal end of the rock anchor leading, until the faceplate is sandwiched between rock wall and the sleeve or the barrel and pushing the anchor further into the rock hole to close the pre-spacing allowing the rock anchor to move relatively to the sleeve to drive the mechanical anchor from the first end of the sleeve and into a radially expansive open position in which the mechanical anchor resistively engages the walls of the rock hole; wherein the pre-spacing of the barrel from the first end of the sleeve or the pre-spacing of the fastener from the barrel is achieved by interposing a tubular spacer on the cable anchor, between the first end of the sleeve and the barrel or between the barrel and the fastener; wherein the pre-spacing is closed by deforming or breaking the tubular spacer.

13. A method according to claim 12 which includes additional steps of engaging a coupling device to the barrel and pumping a grout material from a source through the coupling device and at least one channel provided in a sidewall of the barrel, into an annular space between the sleeve and the cable anchor and into an annular space between the sleeve and walls of the rock hole.

* * * * *